US006994641B2

(12) United States Patent
Hebreo et al.

(10) Patent No.: US 6,994,641 B2
(45) Date of Patent: Feb. 7, 2006

(54) OBJECT STRIKING IMPLEMENT VIBRATION DAMPING

(75) Inventors: Jon Hebreo, Pasadena, CA (US); Dewey Chauvin, Simi Valley, CA (US); Ian Montgomery, Simi Valley, CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 10/807,652

(22) Filed: Mar. 24, 2004

(65) Prior Publication Data

US 2004/0176196 A1 Sep. 9, 2004

Related U.S. Application Data

(62) Division of application No. 10/170,862, filed on Jun. 13, 2002, now Pat. No. 6,767,297.

(51) Int. Cl.
*A63B 59/06* (2006.01)

(52) U.S. Cl. ..... 473/520

(58) Field of Classification Search ..... 473/520, 473/568, 318
See application file for complete search history.

(56) References Cited

U.S. PATENT DOCUMENTS

| | | | | |
|---|---|---|---|---|
| 1,831,255 | A * | 11/1931 | Menzies | 473/316 |
| 5,362,046 | A * | 11/1994 | Sims | 473/300 |
| 6,077,178 | A * | 6/2000 | Brandt | 473/520 |
| 6,117,028 | A * | 9/2000 | You | 473/520 |
| 6,709,352 | B1 * | 3/2004 | Albin | 473/520 |
| 6,764,414 | B2 * | 7/2004 | Kumamoto | 473/297 |

* cited by examiner

*Primary Examiner*—Mark S. Graham
(74) *Attorney, Agent, or Firm*—Roth & Goldman, P.A.

(57) ABSTRACT

Vibrations in the tubular handle of an object striking implement such as a hand tool or ball bat are damped by a vibration damper having a support portion positioned in and engaged with the handle. The vibration damper also has a resilient second portion which cushions contact of the damper with the handle wall and which moves inwardly of the handle in a direction generally transverse to a longitudinal axis of the handle.

5 Claims, 4 Drawing Sheets

OBJECT STRIKING IMPLEMENT VIBRATION DAMPING

CROSS REFERENCE TO RELATED APPLICATIONS, IF ANY

This is a divisional of application Ser. No. 10/170,862 filed Jun. 13, 2002 now U.S. Pat. No. 6,767,297.

BACKGROUND OF THE INVENTION AND PRIOR ART

1. Field of the Invention

The present invention relates to damping of vibration of hollow handle object striking implements such as hammers and other tools, and, more particularly, to sports object striking implements such as bats for baseball, softball and youth play. Such bats are typically made of a metal outer shell formed of aluminum or titanium alloy or other metals.

2. Prior Art

Systems for damping of vibrations in implements such as metal shell bats include what can be generally referred to as tuned mass systems and cushion mass systems. Tuned mass vibration systems employ a moveable object such as a vibration damping pendulum located in a hollow cavity within the bat or other implement which is sized, positioned and frequency matched or tuned to swing within the cavity without contacting the walls of the cavity to effectively damp vibrations incurred when the implement strikes an object. Cushion mass systems employ elastomeric or foam cushions positioned within a cavity in the implement which resiliently come into contact with the walls of the cavity to reduce the amplitude of vibration transferred through the handle of the implement to the user's hand or hands. Since tuned mass vibration damping systems react somewhat more slowly than cushion mass systems due to inertia of the tuned mass, tuned mass systems are the dampers of choice for damping steady state vibration whereas cushion mass dampers are more frequently employed for damping impact induced vibrations.

OBJECT OF THE INVENTION

The primary objective of the invention is to provide an object striking implement with improved vibration damping of the handle.

SUMMARY OF THE INVENTION

The present invention provides an object striking implement having a tubular handle, an object striking portion affixed to said handle and a vibration damper having a support portion affixed in said handle and a resilient damping portion flexibly connected to the support portion. The damping portion is arcuately moveable inwardly of said handle in a direction generally transverse to a longitudinal axis of said handle and is compressible to cushion contact of the damping portion with said handle. The damper therefore functions with some of the characteristics of both tuned mass and cushion mass damping systems.

The vibration damper may be made entirely of resilient material having an undistorted shape and a distorted shape which differs from the undistorted shape when the damper is positioned in the handle.

DESCRIPTION OF THE PREFERRED EMBODIMENTS

Although the invention pertains generally to dampening of vibration in the handles of various types of implements used to strike objects and thus encompasses hammers, axes and other tools and object-striking implements, the invention will be primarily described with reference to ball bats wherein the invention has particular utility.

Figure 1:
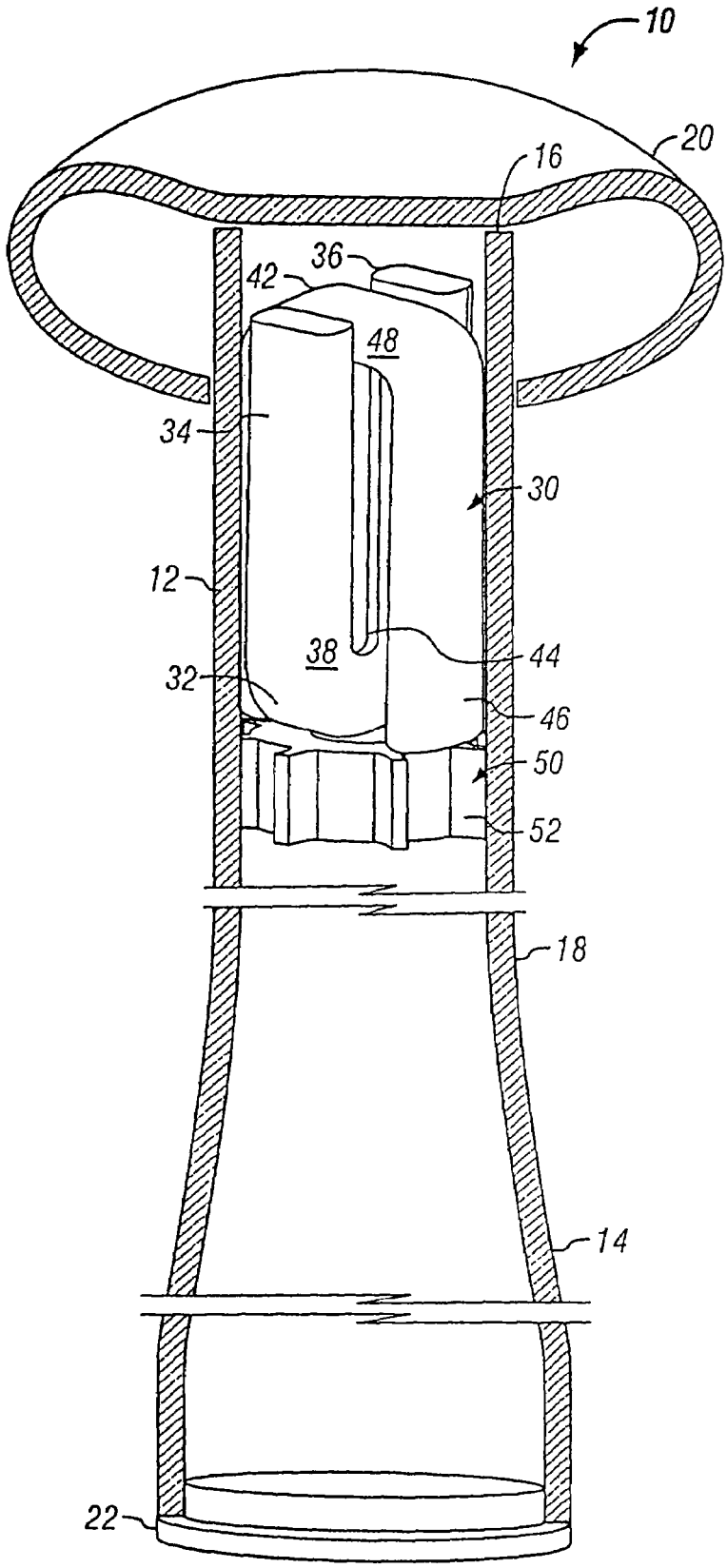
FIG. 1 is a perspective partially cut away view of a first embodiment of a bat with a vibration damper.

The perspective view of FIG. 1 shows an implement comprising a ball bat 10, not to scale, which may be made of metal such as aluminum or titanium, having a tubular handle 12, an object striking portion comprising a barrel 14 which may be integrally formed with the handle, a knob 20 welded, press fit or otherwise affixed to a proximal end 16 of the handle 12 and a barrel end cap 22 press fit, welded or otherwise firmly affixed to the distal end 18 of the barrel 14. Such bats are typically made of tubular aluminum, titanium or other metal or of part metal or may be made of composite construction as is well known in the art. Undesirable vibration is often transmitted to the hand or hands of the user when an object is struck, particularly when the object is struck away from the desired "sweet spot" of the object striking portion of the implement, in this case, whenever a ball is struck other than in the main portion of the barrel 14. The situation is exacerbated in cold weather and when the object is struck close to or on the handle portion of a bat.

A resilient vibration damper 30 is shown in FIG. 1 comprised of first and second elongated members 32, 42 each bent and thereby distorted generally into a U or horseshoe shape when inserted into the handle 12 of the bat 10. Although two U-shaped vibration damping members 32, 42 are shown in this embodiment, a single vibration damper constructed of resilient material such as an elastomer or synthetic elastomer and which is distorted from its ordinary undistorted shape when positioned in the tubular handle 12 of the bat can be used. One portion of the damper, in this case the connecting part or bridge or bridges 38, 48 of the U-shape, is positioned in and resiliently engaged with the interior wall of the handle 12 and the legs 34, 36 of the member 32 (as well as the legs 44, 46 of the member 42, if a second U-shaped member is employed) extend generally axially of the bat handle 12 near or in light contact with the handle wall and are therefore free to flex when subjected to vibration induced by contact with a ball so that the legs 44, 46 can vibrate inwardly of the handle wall in a direction transverse to the longitudinal axis of the handle. As will be apparent from viewing the drawings, the support portion of the damper 30 which is engaged with the handle 12 is axially spaced from the portion or portions of the damper 30 such as the legs 44, 46 which are free to vibrate transverse to the longitudinal axis of the handle 12.

Figure 2:
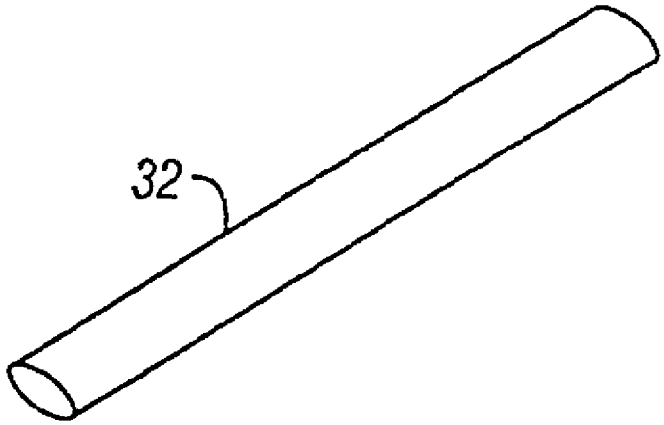
FIG. 2 is a perspective view of the vibration damper used in the embodiment of FIG. 1 in its undistorted shape.

Preferably, the resilient elongated members 32, 42 are formed of a natural or synthetic elastomer such as rubber having a specific gravity of at least 0.75 and preferably 1.0 or higher. The rubber composition preferably also is soft having a Shore durometer hardness in the range from 5 A through 60 D. As seen in FIG. 2, the elongated member 32 preferably has an elliptical cross section having a major axis which equals approximately half of the inner diameter of the handle 12. The member 32 (and member 42 if used) is distorted when positioned in the handle 12 such that the legs of the member or members are circumferentially spaced, preferably equally, in the handle 12.

Because of the damper 30 is distorted when positioned in the handle 12, the elastic memory of the damper causes firm engagement of the distorted support portion of the damper 30 with the interior wall of the handle 12. In this embodiment of the invention, the undistorted length of the elongated member 32 may be about ten times the major axis of the elliptical cross section; however, other lengths can be used so long as the performance characteristics of the bat are not materially altered.

A stopper 50, preferably fabricated of urethane plastic or functionally equivalent material, and preferably having spaced elongate ribs 52 and a hollow interior, may be press fit or adhesively bonded to the bat shell at a selected location to prevent the damper 30 from moving beyond its desired position in the handle 12 into the barrel 14 of the bat. The damper 30 can be easily distorted and slid into the bat handle 12. The ends of the legs 34, 36, 44, 46 that preferably lightly contact the handle 12 when the implement is in a static non-vibrating condition can therefore flex or vibrate inwardly away from the handle wall in a direction transverse to the longitudinal axis of the handle 12 upon impact induced vibration. It will be noted from the drawings that the members 32, 42 are positioned in the handle to permit movement of the legs without contact between the legs of the first member 32 and those of the second member 42 although minor contact during intense vibration of the damper 30 may in fact take place under severe impact induced vibration. The size, weight and resiliency of the above damper 30 and other dampers to be described herein, may be adjusted as necessary to effectively damp vibration of expected frequencies in the handles of the object striking implements with which they are used.

Laboratory tests of impact induced vibrations in metal shell baseball bats have demonstrated that significant improvement in damping vibrations is attainable (tolerable amplitude of vibrations is attained in less time) using dampers as described above and that the weight of the damper itself can be reduced from about 0.43 oz. as used in prior designs using cushioned bat damping by a factor of about 25% using dampers as described above having a weight of about 0.3 oz.

Figure 4:
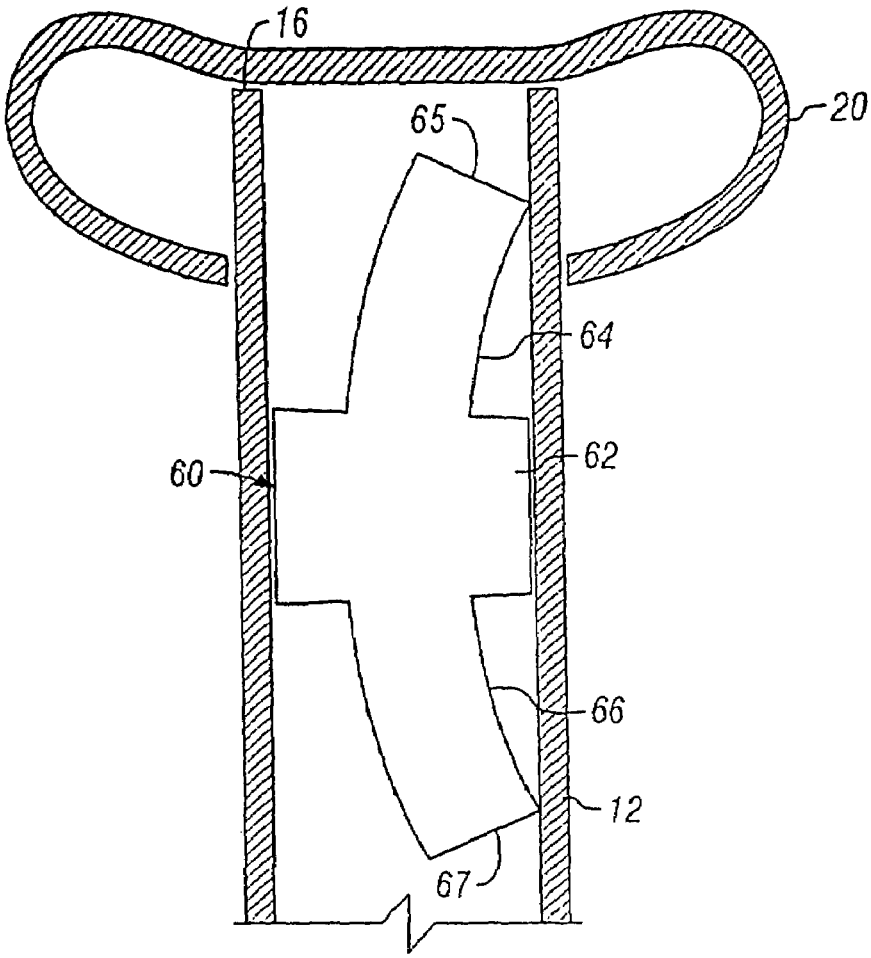
FIG. 4 is a partial axial cross-section of a second embodiment of a bat with a vibration damper.
Figure 5:
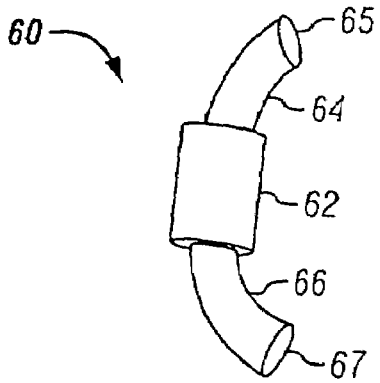
FIG. 5 is a perspective view of the vibration damper used in the embodiment of FIG. 4 in its undistorted shape.

Turning now to the embodiment of the invention seen in FIGS. 4 and 5 wherein like reference numerals depict like parts, a single resilient vibration damper 60 has a first portion 62 preferably of cylindrical cross-section, which is distorted by radial compression and engaged with the interior wall of the handle 12 to hold the damper in desired position in the handle 12. The portion 62 of the damper 60 may be glued into the handle 12 to hold the damper 60 in selected position. The damper 60 also includes elongate second and third portions 64, 66 each having an end 65, 67 which is preferably in light contact with the interior wall of the handle when th bat is in a static condition and is free to flex or vibrate in a direction transverse to the longitudinal axis of the handle upon impact induced vibrations. Although this embodiment of damper is not symmetrical as shown in the drawings, i.e. both ends 65 and 67 engage the same side of the handle 12, an axially symmetrical form of this embodiment can be fabricated with as few as two or three equally circumferentially spaced second and third portions 64, 66 which extend generally in opposite axial directions from the first portion 62. The portions 64, 66 are preferably arcuately configured with a radius of curvature which may be approximately equal to the outer diameter of the handle 12. This ensures that when the damper 60 is properly positioned in the handle 12, at least one of the portions 64, 66 is slightly distorted by contact with the inner wall of the handle 12 and both of the ends 65, 67 are permitted to flex inwardly in a direction transverse to the longitudinal axis of the handle 12. It is not essential that both ends 65, 67 be located in the handle 12 since the end 67 closest to the barrel end of the bat may be slightly displaced from the inner surface of the bat wall as the radius of the wall gradually enlarges toward the barrel of the bat. Other radii of curvature for the arcuate configuration of the portions 64, 66 of the damper 60 can, of course, be chosen so long as the ends 65, 67 resiliently engage the interior wall of the handle 12. The damper 60 is positioned such that the end 65 located near the proximal end 16 of the handle 12 does not contact the inner surface of the end cap 20.

Figure 6:
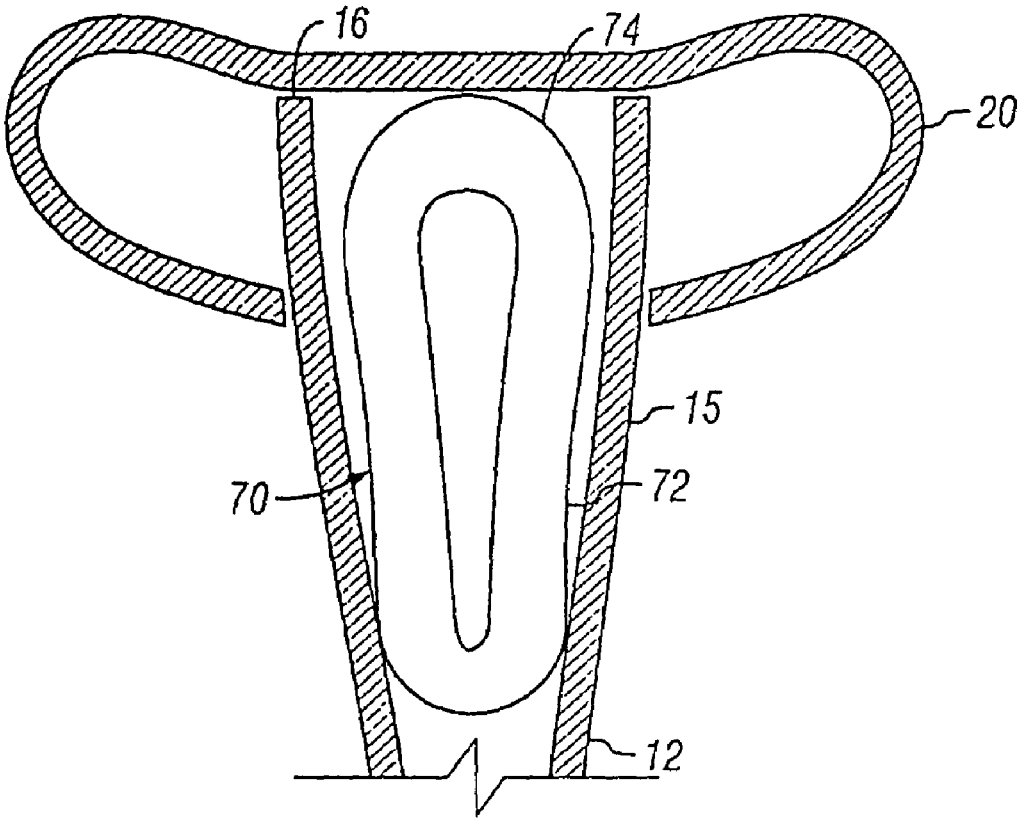
FIG. 6 is a partial axial cross-section of a third embodiment of a bat with a vibration damper.
Figure 7:
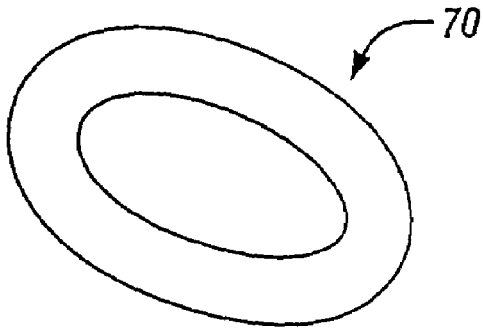
FIG. 7 is a perspective view of the vibration damper used in the embodiment of FIG. 6 in its undistorted shape.

A third exemplary embodiment of the invention is shown in FIGS. 6 and 7 wherein the handle 12 includes a taper forming an enlarged portion 15 near the proximal end 16 and knob 20. The resilient vibration damper 70 in this embodiment preferably has an undistorted shape in the form of a toroid so that the damper 70, when distorted in position in the handle 12, has a first portion 72 which is compressed and resiliently engaged with the handle and a second portion 74 which is free to vibrate in the enlarged portion 15 of the handle 12 in a direction transverse to the longitudinal axis of the handle, the first portion 72 being axially spaced in the handle from the second portion 74.

Figure 3:
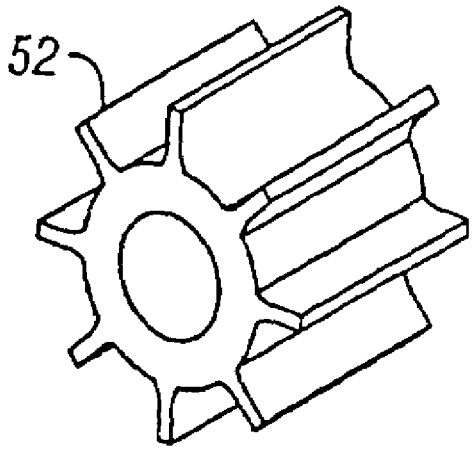
FIG. 3 is a perspective view of a stopper used in the bat of FIG. 1.

In the embodiments of FIGS. 4–7, like the embodiment of FIGS. 1–3, all of which are designed for reducing vibration in bats, the damper preferably comprises an elastomer or synthetic elastomer having a specific gravity of not less than 0.75 and preferably 1.0 or above and is formulated to have a Shore durometer hardness in the range from 5A through 60D.

Those skilled in the art will understand from the foregoing that various other configurations of vibration dampers can be used in addition to the embodiments shown and described. For example, dampers of serpentine, helical or other curved configuration or combinations of curved configurations can be used. The damper may be made wholly or partly of resilient material. Part of the damper engages the interior wall of the handle of the implement and another axially spaced resilient part of the damper is positioned to both vibrate within and collide with the interior wall of the handle resulting in a combination of cushioned and tuned mass damping to dissipate vibration.

Persons skilled in the art will appreciate that various modifications of the invention can be made from the above described preferred embodiment and that the scope of protection is limited only by the following claims.

What is claimed is:

1. An object striking implement having a tubular handle, an object striking portion and a resilient vibration damper having a first portion positioned in and engaged with said handle, said vibration damper having an undistorted shape and a distorted shape when said damper is positioned in said handle which differs from said undistorted shape, said damper having elongate second and third portions each having an end free to flex in a direction transverse to a longitudinal axis of said handle, said first portion being axially positioned between an axially spaced from said second and said third portions, and said first portion being cylindrical and said second and third portions being arcuate and having at least one end which contacts said handle when said implement is in a static condition.

2. The implement of claim 1, wherein said handle has a substantially constant inner diameter and second and third portions have a circular cross-section having a diameter equal to about half said inner diameter of said handle.

3. The implement of claim 2, wherein said damper comprises an elastomer or synthetic elastomer having a specific gravity of not less than 0.75.

4. The implement of claim 2, wherein said damper comprises an elastomer or synthetic elastomer have a Shore durometer hardness in the range of from 5A through 60D.

5. The implement of claim 4, wherein said implement comprises a ball bat.

* * * * *